United States Patent [19]

Wurscher et al.

[11] 4,011,932

[45] Mar. 15, 1977

[54] SERIAL PRINTING DEVICE

[75] Inventors: Horst Würscher, Wilnsdorf; Horst-Werner Bach, Kirburg, both of Germany

[73] Assignee: U.S. Philips Corporation, New York, N.Y.

[22] Filed: July 23, 1975

[21] Appl. No.: 598,178

[30] Foreign Application Priority Data

Aug. 13, 1974 Germany ..... 2438735

[52] U.S. Cl. ..... 197/82; 197/1 R; 197/60; 197/89; 197/186 A

[51] Int. Cl.[2] ..... B41J 19/00

[58] Field of Search ..... 197/1 R, 60, 82, 84 R, 197/84 A, 84 B, 85, 86, 89, 90, 91, 92, 95, 186 R, 186 A

[56] References Cited

UNITED STATES PATENTS

| | | | |
|---|---|---|---|
| 2,138,324 | 11/1938 | Koca | 197/82 |
| 2,875,882 | 3/1959 | Capellaro et al. | 197/82 |
| 3,578,129 | 5/1971 | Kato et al. | 197/19 |
| 3,608,688 | 9/1971 | Hishida et al. | 197/82 |
| 3,759,362 | 9/1973 | Koch | 197/84 R |
| 3,799,312 | 3/1974 | Jozuka | 197/82 |
| 3,819,028 | 6/1974 | Drillick | 197/82 |

*Primary Examiner*—Ralph T. Rader
*Attorney, Agent, or Firm*—Frank R. Trifari; David R. Treacy

[57] ABSTRACT

A printing device and a carriage transport motor are mounted separately on a carriage and driven in a stepwise manner. The motor shaft rolls over a rubber guide at least under the influence of the weight of the motor, while a driving pinion on the shaft engages a rack.

10 Claims, 3 Drawing Figures

SERIAL PRINTING DEVICE

The invention relates to a serial printing device for typewriters and booking machines which is stepwise driven by an electric motor and more particularly to a mounting and transport mechanism for a printing head, the transport and the printing being controlled by means of a position pulse generator arranged on the motor shaft.

In known serial printing devices of this kind, notably in needle printing devices, the printing device is indirectly driven, which means that the printing device itself is journalled to be slidable on guide rails extending parallel to the printing plane, the drive motor being rigidly connected to the machine frame and driving the printing device by means of a belt or rod transmission.

Because the acceleration of the printing device by such transmission members causes vibrations, the known devices necessitate a substantially constant speed during the printing of a character, which is printed either in its entirely or which is composed of individual characters. This means that during the periods of acceleration as well as during the periods of braking no character or parts of a character can be printed if the characters are not allowed to be irregular as far as their screen is concerned. For the serial printing of individual characters these known printing devices, consequently, require a given starting path prior to printing and a given stopping path after printing. These methods are time-consuming and give rise to increased wear of the drive system.

The object of the invention is to realize a drive of a printing device which has simple construction and which enables printing of the characters also during the acceleration and braking periods, without causing a variation of the screen dimension. This object is achieved in accordance with the characteristics given in the Claims.

The drive system of a printing device according to the invention operates slip-free and enables tabulating and fast return movements, in combination with a substantial reduction of the noise level. The electric motor, used for driving, is controlled by a position pulse generator mounted on the motor shaft. The pulse generator may operate inductively, capacitively or optically in as far as the scanning is statically effected. The pitch of the pulse generator disc may be equal to or may be a number of times smaller than the smallest distance of the printing screen. The position pulse generator operates in any known manner, the scanning of the pulse disc being effected by means of two transducers, for example, photodiodes which supply two 90°-shifted squarewave pulses wherefrom the forward and backward control of a suitable counter can be derived by means of a logic differentiating member.

The further electronic control device consists of known elements and operates according to the absolute positioning principle. The required value of the location to be positioned is applied to a register in the machine, and is subsequently stored therein. The actual-value counter, directly controlled by the position pulse generator in the forward and backward directions, is continuously compared with the required-value register by way of a comparison circuit. The control circuit ensures that the drive motor is actuated, until the actual value corresponds to the required value.

The invention will be described in detail hereinafter with reference to an embodiment according to the invention which is shown in the accompanying drawing.

The drawings show a construction carrying a needle printing head. However, other printing devices such as lever or ink jet printing devices can also be used. The electronic circuit for performing the printing and transport movements is of any well known type and is not elaborated in the figures.

Figure 1:
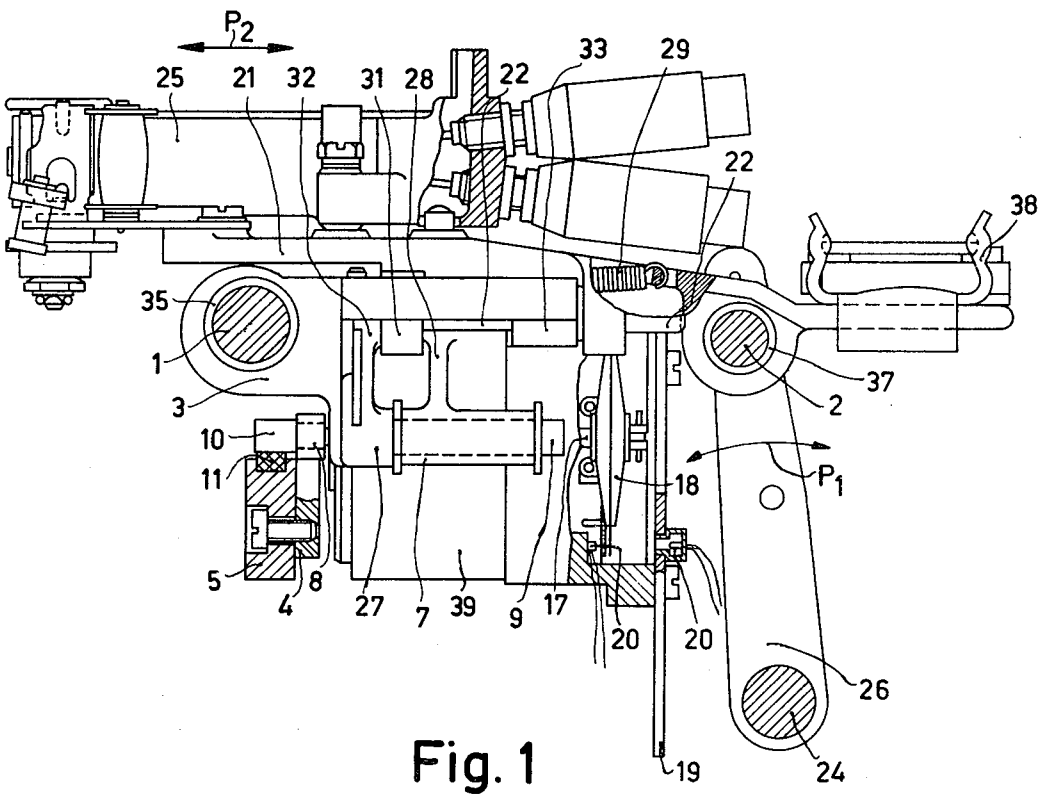
FIG. 1 is a side elevation of a printing device according to the invention, viewed in the printing direction.
Figure 2:
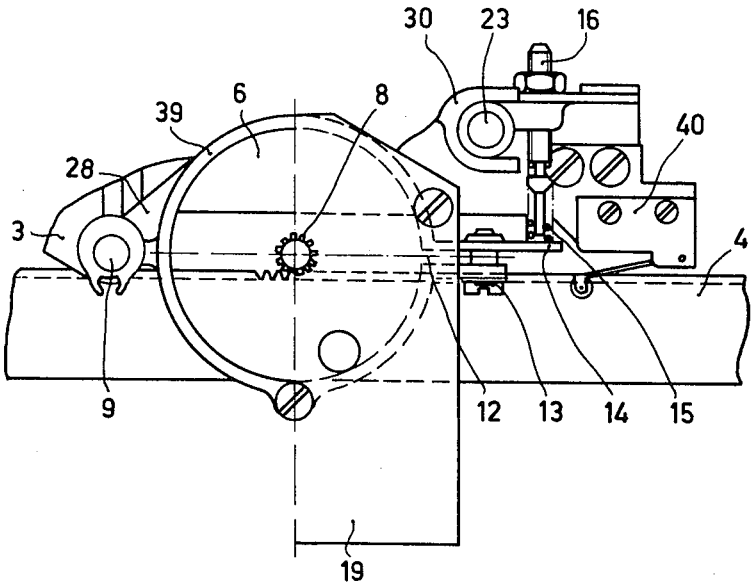
FIG. 2 is a partial elevation of the motor and front frame of the printing device shown in a FIG. 1, viewed in the direction perpendicular to the printing direction.
Figure 3:
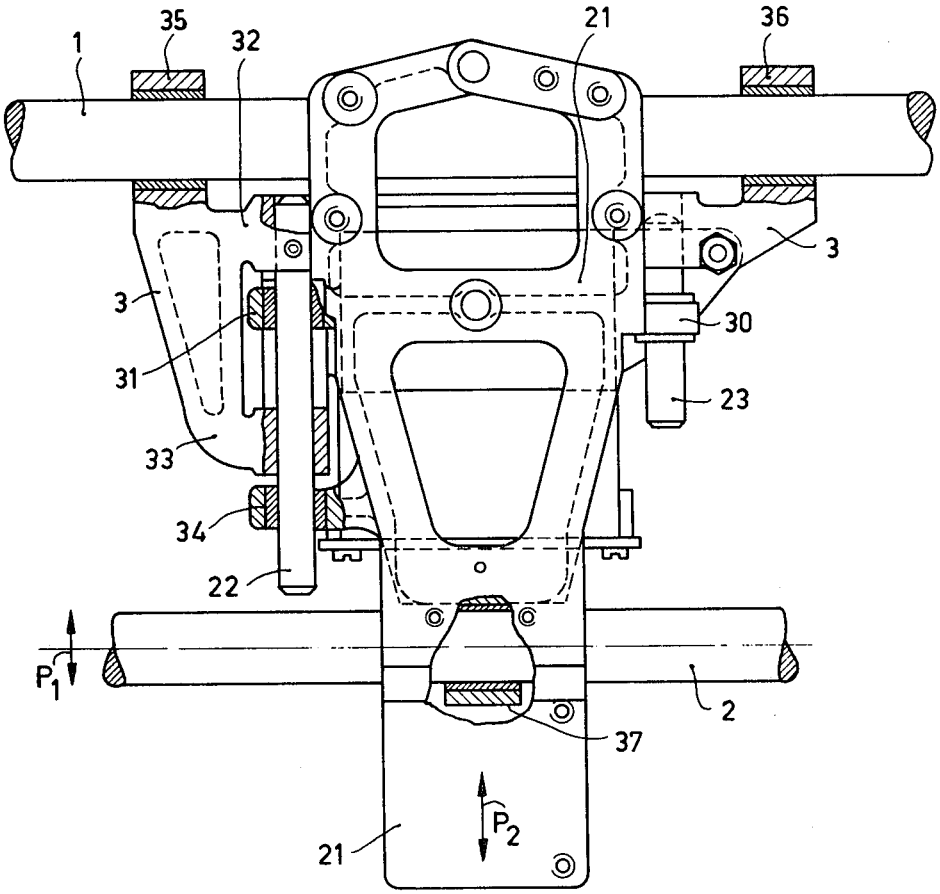
FIG. 3 is a plan view after removal of the device of FIG. 1 with the printing device removed.

In the frame of the machine (not shown) a guide rail 1 is rigidly mounted, and a second rail 2 is mounted on two levers 26, only one of which is shown in FIG. 1 parallel to the rail 1; these levers are rotatable about the shaft 24 in the direction of the arrow P1. In the operating position of the rail 2 shown in FIG. 1, this rail is pulled to the left by the spring 29. A front frame 3 with bearing bushing 35 and 36 is arranged to be slidable on the rail 1. A second rear frame 21 is arranged to be slidable on the rail 2 by the bearing bushing 37. The sliding of the two frames 3 and 21 is effected parallel to the printing plane. The printing head 25 is rigidly mounted on the frame 21. In the embodiment shown, a needle printing head is used as the printing device, the character to be printed consisting of a dot screen. Alternatively, any other suitable printing devices can also be mounted on the frame 21. The frame 3 has a projection 27 which includes a fixed pin 9 whereon a sleeve 7 of a split ring supporting frame 39 has been slid. This supporting frame 39 is arranged about an electric motor 6, with a gap 12 on the other side of the electric motor 6 from the sleeve 7, so that the split ring supporting frame 39 can be clamped by a screw 13.

The two frames 3 and 21 are connected to each other by a sleeve bearing, the sliding direction of which is perpendicular to the printing plane. This sleeve bearing comprises the two sliding pins 22 and 23 which are anchored in the basic frame 3 and the eyes 30, 31 and 34 which are rigidly connected to the basic frame 21. The sliding pin 22 is furthermore fitted in the bushing 33 of the frame 3. When the frame 21 of the printing head 25 moves against the force of the tensile spring 29 due to swiveling of the levers 26, the swiveling is limited by the sleeve 33. In the active position of the frame 21, the front of the projection 32, wherein the pin 22 is rigidly accommodated, forms a limit stop. On the rear of the frame 21 a block 38 is mounted for connection of the electrical supply leads for the control of the electric motor 6 and the printing device 25.

The split ring supporting frame 39 is connected to the sleeve 7 by way of a connection piece 28, so that the electric motor 6 can pivot about the pin 9. On the device shaft 17 of the motor there is provided a pinion 8 which is held in engagement with a toothed rack 4 by the weight of the electric motor itself and of that of the supporting frame 39. This rack 4 is mounted on a supporting bar 5 parallel to the rails 1 and 2, which bar in its turn is rigidly connected (not shown) to the frame of the machine. When the motor 6 is switched on, the pinion 8 rolls down the rack 4, thus putting the motor and the printing device 25 into motion.

On the shaft 17 there is also provided a steel cylinder 10 which, during the movement of the electric motor and the printing device, rolls along a rubber guide 11 which is secured in a groove of the supporting bar 5. The diameter of the cylinder 10 corresponds to the diameter of the pitch circle of the pinion 8, so that engagement forces perpendicular to the direction of travel are not taken up by the pinion 8 but by the rubber guide 11. As a result, the pinion 8 can roll down the rack 4 in a no-load condition, so that the noise level is low. The pressure on the guide 11, having a given minimum value which is determined by the weight of the electric motor 6 and that of the supporting frame 9, can be increased by means of an adjusting spring 15 which acts on a lug 14 of the supporting frame 39, and the force of which can be varied by way of an adjusting screw 16.

On the motor shaft 17 there is also mounted a position pulse generator 18, the position of which is read by a photoelectric scanning device 20. This scanning device 20 consists of two light elements, only one of which is shown in FIG. 1; each of these elements indicates the absolute positioning and movement direction of the electric motor 6 in known manner. The electronic circuit components required for the control of the electric motor are mounted on a printed circuit board 19 which is mounted on the frame 3.

When the operating voltages are first switched on, the entire drive of the printing device is set to a defined zero position. A switch 40 ensures on the one hand that this defined zero position is maintained, and on the other hand, by switching off at the end of a line, that the printing device can continue neither at the beginning of the line nor at the end thereof.

The friction of the bearing bushes 35, 36, 37 of the pinion 8 and of the cylinder 10 over the rubber guide 11 not only ensures proper damping of the drive, but notably also prevents unnecessary vibrations in the control system which could have an adverse effect on the position pulse generator 18. The electric motor 6 is controlled in any known manner by a control system, which in turn is controlled in accordance with a difference decoding network (not shown). When the printing device is situated in a location far from the location to be positioned, the motor is fed with a high voltage. When a predetermined location is approached, the difference decoding device automatically step-wise reduces the control voltage. This step-wise reduction is effected in accordance with the character screen and can be programmed by means of a fixed-value store.

Because the position pulse generator 18 and the pinion 8 are mounted on the common drive shaft 17, no disturbing vibrations can occur in the printing device, and the printing device 25 can readily print a character during the periods of acceleration as well as during the periods of braking, without the screen dimension being adversely effected. To this end, the distance between the teeth of the pinion and the slot distance of the position pulse generator are advantageously adapted to the screen dimension to be printed.

What is claimed is:

1. In a serial printing device, an improved mounting and transport mechanism for a printing head, comprising first and second elongated guide rails parallel to each other, a rack extending parallel to said first guide rail across an entire width of printing, a first frame, means for transporting said first frame, comprising an electric motor mounted on said first frame, a drive shaft extending transversely to said first guide rail, and a pinion on the shaft, said pinion engaging said rack, a second frame slidably mounted on at least said second guide rail for motion along said second guide rail, means for supporting said second frame with respect to said first guide rail, means for mounting a printing head on said second frame, and means for interconnecting said first and said second frames for relative motion, comprising a bearing bushing mounted in one of the frames, and a pin rigidly mounted in the other frame transversely to said guide rails and slidably fitted in said bearing bushing.

2. A mechanism as claimed in claim 1, comprising in addition a position pulse generator mounted on the motor shaft, said generator comprising a slotted disc.

3. A mechanism as claimed in claim 2, wherein a distance between slots of the generator and a distance between teeth of the rack correspond to a screen dimension of characters to be printed.

4. A mechanism as claimed in claim 1, comprising in addition a rubber guide extending adjacent and parallel to the rack, wherein said drive shaft comprises a circular cylindrical surface co-axial with said pinion, arranged for rolling engagement with said guide.

5. A mechanism as claimed in claim 4 wherein said motor is so arranged on said first frame that weight of the motor urges said pinion and cylinder into engagement with said rack and rubber guide respectively.

6. A mechanism as claimed in claim 5, wherein said pinion and cylinder are additionally urges into engagement with said rack and rubber guide by an adjustable spring.

7. A mechanism as claimed in claim 1, comprising means for pivotally mounting said second guide rail for relative motion toward and away from said first guide rail, and wherein said supporting means comprises means for slidably mounting said first frame on said first guide rail for motion along said first rail.

8. A mechanism as claimed in claim 7, comprising a supporting frame pivotably connected to said first frame about an axis parallel to said drive shaft, said motor being mounted on said supporting frame.

9. A mechanism as claimed in claim 8, comprising in addition a rubber guide extending adjacent and parallel to the rack, wherein said drive shaft comprises a circular cylindrical surface co-axial with said pinion, arranged for rolling engagement with said guide, and wherein said motor is so arranged on said supporting frame that weight of the motor urges said pinion and cylinder into engagement with said rack and rubber guide respectively.

10. A mechanism as claimed in claim 8, wherein said pivotal connection to the support frame, said pin and bushing, and the slidable mountings of the first and second frames consist of sleeve bearings.

* * * * *